United States Patent [19]

Forester

[11] Patent Number: 4,927,519

[45] **Date of Patent: * May 22, 1990**

[54] METHOD FOR CONTROLLING FOULING DEPOSIT FORMATION IN A LIQUID HYDROCARBONACEOUS MEDIUM USING MULTIFUNCTIONAL ANTIFOULANT COMPOSITIONS

[75] Inventor: David R. Forester, Spring, Tex.

[73] Assignee: Betz Laboratories, Inc., Trevose, Pa.

[ * ] Notice: The portion of the term of this patent subsequent to May 9, 2006 has been disclaimed.

[21] Appl. No.: 208,203

[22] Filed: Jun. 17, 1988

Related U.S. Application Data

[63] Continuation-in-part of Ser. No. 177,252, Apr. 4, 1988, Pat. No. 4,828,674.

[51] Int. Cl.[5] ..... C10G 9/12

[52] U.S. Cl. ..... 208/48 AA; 208/48 R; 252/358; 252/32.7 E

[58] Field of Search ..... 252/400.2, 32.7 E, 33, 252/389.22, 358; 208/40 AA, 48 R, 187, 108

[56] References Cited

U.S. PATENT DOCUMENTS

| | | | |
|---|---|---|---|
| 2,785,128 | 3/1957 | Popkin | 252/32.7 |
| 2,916,454 | 12/1959 | Bradley et al. | 252/42.7 |
| 3,105,810 | 10/1963 | Miller et al. | 208/48 |
| 3,135,729 | 6/1964 | Kluge et al. | 260/139 |
| 3,201,438 | 8/1965 | Reed | 260/461 |
| 3,271,295 | 9/1966 | Gonzalez | 208/48 |
| 3,271,296 | 9/1966 | Gonzalez | 208/48 AA |
| 3,301,923 | 1/1967 | Skovronek | 260/953 |
| 3,437,583 | 4/1969 | Gonzalez | 208/48 |
| 3,442,791 | 5/1969 | Gonzalez | 208/48 |
| 3,489,682 | 1/1970 | Lesver | 252/32.7 |
| 3,567,623 | 3/1971 | Hagney | 208/48 |
| 3,776,835 | 12/1973 | Dvoracek | 208/48 AA |
| 4,024,049 | 5/1917 | Shell et al. | 208/48 AA |
| 4,024,051 | 5/1977 | Shell et al. | 208/187 X |
| 4,105,540 | 8/1978 | Weinland | 208/48 AA |
| 4,107,030 | 4/1978 | Slovinsky et al. | 208/48 AA |
| 4,123,369 | 10/1978 | Miller et al. | 252/33 Y |
| 4,556,476 | 12/1985 | Miller et al. | 208/48 AA |
| 4,578,178 | 3/1986 | Forester | 208/48 AA |
| 4,618,411 | 10/1986 | Dickakian | 208/48 AA |
| 4,619,756 | 10/1986 | Dickakian | 208/48 AA |

*Primary Examiner*—Glenn Caldarola

*Attorney, Agent, or Firm*—Roslyn T. Tobe; Alexander D. Ricci

[57] ABSTRACT

A method for controlling the formation of fouling deposits in a liquid hydrocarbonaceous medium, wherein in the absence of such fouling inhibition, fouling deposits would normally be formed within said medium is disclosed. The method comprises adding to said medium an antifoulant composition comprising a basic antifouling compound, component (1), selected from the group consisting of alkyl phosphonate phenate sulfide, alkaline earth alkyl phosphonate phenate sulfide, an amine neutralized alkyl phsophonate phenate sulfide, or mixtures thereof, and at least one additional antifouling compound selected from components (2), (3) and (4) wherein component (2) is an effective antioxidant compound adapted to inhibit oxygen based polymerization of said hydrocarbon or petrochemical, component (3) is a corrosion inhibiting compound, and component (4) is a metal deactivator. The process comprises adding from about 0.5 to about 10,000 parts of the combination of (1) and additional antifoulant component(s) to the particular hydrocarbonaceous medium for which multifunctional antifouling protection is desired.

83 Claims, No Drawings

METHOD FOR CONTROLLING FOULING DEPOSIT FORMATION IN A LIQUID HYDROCARBONACEOUS MEDIUM USING MULTIFUNCTIONAL ANTIFOULANT COMPOSITIONS

This application is a continuation-in-part of Ser. No. 177,252 filed Apr. 4, 1988 now U.S. Pat. No. 4,828,674.

FIELD OF THE INVENTION

The present invention pertains to methods for providing antifouling protection for hydrocarbonaceous mediums, such as a petroleum hydrocarbon or petrochemical during processing thereof. These hydrocarbons are commonly processed at temperatures of 100° to 1000° F. These methods serve to deactivate metals in contact with the process streams, inhibit oxidation of the process fluid, and inhibit corrosion of the metallurgy in contact with the process fluid.

BACKGROUND

In the processing of petroleum hydrocarbons and feedstocks such as crude oil and petroleum processing intermediates, and petrochemicals and petrochemical intermediates, e.g., gas, oils and reformer stocks, chlorinated hydrocarbons and olefin plant fluids such as deethanizer bottoms, the hydrocarbons are commonly processed at temperatures of 100° to 1000° F. Similarly, such petroleum hydrocarbons are frequently employed as heating mediums on the "hot side" of heating and heat exchange systems such as vacuum tower bottoms and slurry systems. In both instances, the petroleum hydrocarbon liquids are subjected to elevated temperatures which produce a separate phase known as fouling deposits, within the petroleum hydrocarbon. In all cases, these deposits are undesirable by-products. In many processes, the deposits reduce the bore of conduits and vessels to impede process throughput, impair thermal transfer, and clog filter screens, valves and traps. In the case of heat exchange systems, the deposits form an insulating layer upon the available surfaces to restrict heat transfer and necessitate frequent shutdowns for cleaning. Moreover, these deposits reduce throughput, which, of course, results in a loss of capacity with a drastic effect in the yield of finished product. Accordingly, these deposits have caused considerable concern to the industry.

Organic foulants are usually higher molecular weight materials ranging in consistency from that of tar to rubber to "popcorn" to "coke". The exact composition of such foulants is difficult to identify.

One particularly troublesome type of organic fouling is caused by the formation of polymers that are insoluble in the hydrocarbon or petrochemical fluid being processed. The polymers are usually formed by reactions of unsaturated hydrocarbons, although any hydrocarbon can polymerize. Generally, olefins tend to polymerize more readily than aromatics, which in turn polymerize more readily than paraffins. Trace organic materials containing hetero atoms such as nitrogen, oxygen and sulfur also contribute to polymerization.

Polymers are formed by free radical chain reactions. These reactions, shown below, consist of two phases, an initiation phase and a propagation phase. In reaction 1, the chain initiation reaction, a free radical represented by R·, is formed (the symbol R can be any hydrocarbon). These free radicals, which have an odd electron, act as chain carriers. During chain propagation, additional free radicals are formed and the hydrocarbon molecules (R) grow larger and larger (see reaction 2*c*), forming the unwanted polymers which accumulate on heat transfer surfaces.

Chain reactions can be triggered in several ways. In reaction 1, heat starts the chain. Example: when a reactive molecule such as an olefin or a diolefin is heated, a free radical is produced. Another way a chain reaction starts is shown in reaction 3, where metal ions initiate free radical formation. Accelerating polymerization by oxygen and metals can be seen by reviewing reactions 2 and 3.

1. Chain Initiation $R—H \rightarrow R\cdot + H$

2. Chain Propagation a. $R\cdot + O_2 \rightarrow R—O—O\cdot$ b. $R—O—O\cdot + R'—H \rightarrow R'\cdot + R—O—O—H$ c. $R\cdot + C{=}C \rightarrow R—C—C \rightarrow$ polymer 3. Chain Initiation a. $Me^{++} + RH \rightarrow Me^{+} + R\cdot + H^{+}$ b. $Me^{++} + R—O—O—H \rightarrow Me^{+} + R—O—O\cdot + H^{+}$ 4. Chain Termination a. $R\cdot + R' \rightarrow R—R'$ b. $R\cdot + R—O—O \rightarrow R—O—O—R$ Research indicates that even very small amounts of oxygen can cause or accelerate polymerization. Accordingly, to inhibit this insidious fouling problem, it is highly desirable to provide a polyfunctional process antifoulant which can, among other functions, inhibit oxygen based polymerization initiation. This antioxidant function serves as a "chain-stopper" by forming inert molecules with the oxidized free radical hydrocarbons, in accordance with the following reaction:

Chain Termination $$ROO\cdot + \text{Antioxidant} \rightarrow ROOH + \text{Antioxidant}\cdot(—H)$$

In addition to the desirability of inhibiting oxygen based polymerization, it is highly desirable to inhibit the catalytic formation of gums and other deposits, which are caused by metallic impurities, such as copper and/or iron, which may be present in the process fluids. These types of antifoulants are referred to as "metals coordinators" or "metal deactivators" and function by the formation of a complex or ligand with the metallic impurity in the process fluid.

Unlike organic deposits, inorganic deposits can be simple to identify. One example is ammonium chloride formed as the reaction product of injected ammonia in a crude overhead system. Other inorganic deposits include e.g., metallic salts, oxides, sulfides, etc. of iron, copper and vanadium. Such deposits may be present in the original feed as "ash" or they may be the result of corrosion or precipitation in equipment where fouling is evident. In some cases, fouling and corrosion may be related in that solving the corrosion problem which exists upstream may improve the downstream fouling problem.

As to the problem of corrosion, the root of this problem is usually attributed to HCl or $H_2S$ contamination of the aqueous phase that is entrained in the process fluid. Other acids such as carboxylic and carbonic acids may also exacerbate the corrosion problem.

Corrosive attack on the metals normally used in the low temperature sections of a refinery processing system, i.e., where water is present below its dew point, is an electrochemical reaction, generally in the form of acid attack on active metals as shown in equation 1.

$$\text{At the anode } Fe \rightarrow Fe^{++} + 2(e) \quad (1)$$

$$\text{At the cathode } 2H^{+} + 2(e) \rightarrow 2H \quad (2)$$

$$2H \rightarrow H_2 \quad (2a)$$

Equation 2 expresses the reduction of hydrogen ions to atomic hydrogen. The rate of the cathodic reaction generally controls the overall corrosion rate.

The aqueous phase is simply water entrained in the hydrocarbons being processed and/or water added to the process for such purposes as steam stripping. Acidity of the condensed water is due to dissolved acids in the condensate, principally HCl and $H_2S$. The HCl is formed by hydrolysis of calcium and magnesium chlorides originally present in the brines produced concomitantly with the hydrocarbons—oil, gas, condensates.

The bulk of these brines are separated at the field production facilities. Most of what remains after field separation is removed by desalting equipment at the refinery, upstream of the crude still and subsequent processing units.

Even under the best of conditions, however, a small amount of salt, several pounds per thousand barrels of charge (ptb expressed as NaCl) will reach the crude still. A portion of this, principally the chlorides of calcium and magnesium, decompose to give gaseous HCl which dissolves in overhead condensates and forces the pH down as low as 2 to 3, which is severely corrosive to steel equipment. With sour crudes, an additional corrodent is $H_2S$, either originally present in the sour oil, gas or condensate production and/or formed at processing temperatures by decomposition of sulfur compounds in the charge stocks. Certain sulfur compounds, such as low-molecular-weight, water-soluble mercaptans may also be corrodents.

There are many areas in the hydrocarbon processing industry where antifoulants have been used successfully; the main treatment areas are discussed below.

In a refinery, the crude unit has been the focus of attention, primarily because fuel use directly impacts on processing costs. Antifoulants have been successfully applied at the exchangers; downstream and upstream of the desalter, on the product side of the preheat train, on both sides of the desalter makeup water exchanger, and at the sour water stripper.

Hydrodesulfurization units of all types experience preheat fouling problems. Among those that have been successfully treated are reformer pretreaters processing both straight run and coker naphtha, desulfurizers processing catalytically cracked and coker gas oils, and distillate hydrotreaters. In one case, fouling of a Unifiner stripper column was solved by applying a corrosion inhibitor upstream of the problem source.

Unsaturated and saturated gas plants (refinery vapor recovery units) experience fouling in the various fractionation columns, reboilers and compressors. In some cases, a corrosion control program along with the antifoulant program gave the best results. In other cases, antifoulants alone were enough to solve the problem.

Cat cracker preheat exchanger fouling, both at the vacuum column and at the cat cracker itself, has also been corrected by the use of antifoulants.

In heavy oil treating and cracking units, fouling of preheat trains of the vacuum tower bottoms feedstock has been successfully reduced by antifoulants.

In petrochemical plants, the two most prevalent areas for fouling problems are ethylene and styrene plants. In an ethylene plant, the furnace gas compressors, the various fractionating columns and reboilers are subject to fouling.

In butadiene plants, absorption oil fouling and distillation column and reboiler fouling have been corrected with various types of antifoulants.

Chlorinated hydrocarbon plants, such as VCM, EDC and perchloroethane and trichloroethane have also experienced various types of fouling problems.

The present invention is directed toward methods using multifunctional antifoulant compositions which are useful in controlling fouling encountered in the petroleum and petrochemical systems above-identified. More specifically, these methods and compositions, due to their multifunctional characteristics, may be applied effectively to inhibit fouling caused by oxygen-based free radical formation, metal catalysis, corrosion and polymer aggregation.

SUMMARY OF THE INVENTION

I have found a method using multifunctional antifoulant compositions to control fouling in petroleum, petrochemical and hydrocarbon systems. Since the composition is multifunctional it can be applied to inhibit fouling from different causes; namely, oxygen-based free radical formation, metal catalysis, corrosion and polymer aggregation.

The multifunctional process antifoulants are comprised of a basic antifoulant, component (1), comprising an alkyl phosphonate phenate sulfide or alkaline earth or amine salt thereof and at least one additional compound, selected from components (2), (3), (4) and mixtures thereof as described below. Component (2) is an antioxidant compound adapted to inhibit oxygen based polymerization in petrochemical or hydrocarbon process streams; component (3) is a corrosion inhibition agent such as a tetrahydropyrimidene compound; and component (4) is a metal deactivator compound. In accordance with the invention, one or more of such compositions are admitted to the desired liquid hydrocarbonaceous medium in an amount of from about 0.5 to about 10,000 ppm to inhibit fouling and deposit formation that would otherwise occur. These antifoulant compositions are preferably added to the liquid hydrocarbon medium during high temperature treatment thereof.

As used herein, the phrase "liquid hydrocarbonaceous medium" signifies various and sundry petroleum hydrocarbon and petrochemicals. For instance, petroleum hydrocarbons such as petroleum hydrocarbon feedstocks including crude oils and fractions thereof such as naphtha, gasoline, kerosene, diesel, jet fuel, fuel oil, gas oil, vacuum residua, etc., may all be benefitted by using the antifoulant treatments herein disclosed and claimed.

Similarly, petrochemicals such as olefinic or naphthenic process streams, ethylene glycol, aromatic hydrocarbons and their derivatives may all be successfully treated using the inventive treatments herein described and claimed.

PRIOR ART

Over the years, a variety of antifoulants have been provided by various chemical suppliers to treat a variety of petroleum hydrocarbon and/or petrochemical process streams. Particularly successful antifoulants are the polyalkenylthiophosphonic acid esters disclosed in U.S. Pat. No. 4,578,178 (Forester), of common assignment herewith.

Other patents in the antifoulant field which may be of interest to the present invention include: U.S. Pat. No. 4,024,051 (Snell) disclosing the use of inorganic phosphorus containing acid compounds and/or salts thereof as antifoulants; U.S. Pat. No. 3,105,810 (Miller) disclosing oil soluble alkaryl sulfur containing compounds as antifoulants; U.S. Pat. No. 4,107,030 (Slovinsky et al.) disclosing sulfanilic acid amine salt compounds as antifoulants; U.S. Pat. No. 3,489,682 (Lesuer) disclosing methods for preparing metal salts of organic phosphorus acids and hydrocarbon substituted succinic acids; and U.S. Pat. No. 2,785,128 (Popkin) disclosing methods for preparing metal salts of acidic-phosphorus-containing organic compounds.

U.S. Pat. Nos. 3,437,583 (Gonzalez); 3,567,623 (Hagney); 3,271,296 (Gonzalez); 3,442,791 (Gonzalez); and 3,271,295 (Gonzalez); 3,201,438 (Reed); 3,301,923 (Skovronek); 4,024,049 (Shell); and 4,105,540 (Weinland) may also be mentioned as being of possible interest.

The alkyl phosphonate phenate sulfides and the preferred alkaline earth alkyl phosphonate phenate sulfides used as antifoulants in accordance with the invention are not new. These materials are described in U.S. Pat. No. 4,123,369 (Miller et al.). However, '369 Miller et al. discloses that such materials are useful in lubricating oil compositions. In contrast, the present invention employs these compounds in combination with additional antifouling components to inhibit fouling in liquid hydrocarbon mediums such as in petroleum hydrocarbons or petrochemicals. Studies have shown that many compounds known to be useful as lubricating oil detergent-dispersants do not adequately function as process antifoulants.

The combination of antioxidants, corrosion inhibitors, and/or metal deactivators with detergents and/or dispersants for use as antifoulants is taught in U.S. Pat. Nos. 3,776,835 (Dvoracek), 4,619,756 (Dickakian) and 4,618,411 (Dickakian). However, none of these patents claim or teach the use of alkyl phosphonate phenate sulfides with these other antifouling components.

DETAILED DESCRIPTION OF THE PRESENT INVENTION

I have found that alkyl phosphonate phenate sulfides (PPS), when used as the basic antifoulant, component (1), of the multifunctional compositions and related processes, provide improved antifoulant efficacy when compared with PPS type products alone.

Preparative routes for synthesizing component (1) begin with the reaction of an alkyl phenol of the formula

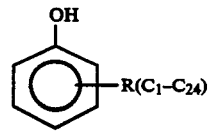

with sulfur monochloride or sulfur dichloride. Such reaction is well known and is reported in U.S. Pat. No. 2,916,454 (Bradley et al.), the disclosure of which is incorporated by reference herein.

As reported by Bradley et al., the relative proportions of the alkyl phenol and sulfur compound used greatly affects the resulting product. For instance, in accordance with Bradley et al., three possible products of the reaction include "(1) A product prepared by the reaction of 4 moles of a monoalkyl-substituted phenol with 3 moles of sulfur dichloride:

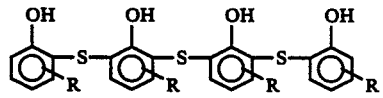

where R represents an alkyl radical.

(2) A product prepared from 2 moles of an alkyl phenol with 1 mole of sulfur dichloride:

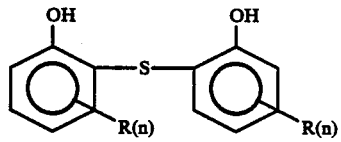

where R represents an alkyl radical and n is an integer from 1 to 4.

(3) A product prepared from an alkyl phenol with sulfur dichloride in a 1:1 mole ratio:

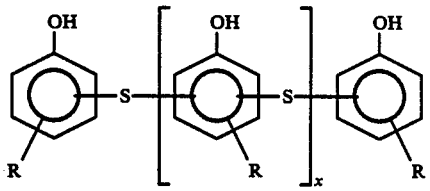

where R represents an alkyl radical and x is an integer of 2 to about 6. These products are usually referred to as phenol sulfide polymers."

In addition to products such as the above, as Bradley et al. states, the phenol sulfide reaction products may, in many cases, comprise minor amounts of mixtures of various phenol sulfides such as

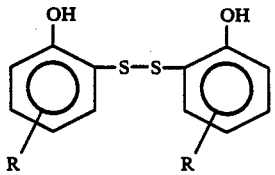

-continued

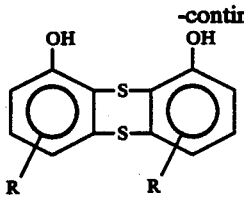

and

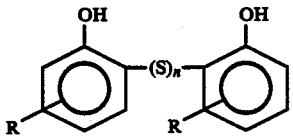

where n may be 3 to about 6.

These alkyl phenol sulfides are then partially or completely esterified via reaction with phosphoric acid to produce alkyl phosphonate phenate sulfides (PPS) which may be used as an antifoulant treatment in accordance with the invention.

It is preferred to only partially esterify the available hydroxyls with $H_3PO_4$ and then to react the partially phosphonated product with the oxides or hydroxides of alkaline earth metals such as $Ca(OH)_2$, CaO, MgO, $Mg(OH)_2$, etc. In this manner, alkaline earth metal alkyl phosphonate phenate sulfides are prepared. Such reactions are discussed at column 4 of U.S. Pat. No. 4,123,369 (Miller et al.), incorporated by reference herein. The preferred basic antifoulant, component (1), of the invention is a slightly over based calcium alkyl phosphonate phenate sulfide (CPPS) thought to be produced by the reaction scheme specified in columns 3 and 4 of the aforementioned '369 patent.

PPS may also be neutralized with an amine for use as component (1) of the invention. The neutralizing amine is selected from the group consisting of ammonia, alkylamines, arylamines, cycloalkylamines, alkanolamines, fatty amines, oxyalkylene amines, hydroxylated polyamines and mixtures thereof. Exemplary amines include, but are not limited to:

(a) alkanolamines, such as monoethanolamine, diethanolamine, triethanolamine, bis-(2-hydroxyethyl)-butylamine, N-phenyl-diethanolamine, diisopropanolamine, triisopropanolamine and the like.

(b) alkylamines, such as ethylamine, propylamine, butylamine, and the like.

(c) arylamines, such as aniline, benzolaniline, ethylphenylamine, and the like.

(d) cycloalkylamines, such as cyclohexylamine, and the like.

(e) fatty amines, such as cocoamine, tallowamine, cetylamine, heptadecylamine, n-octylamine, n-decylamine, laurylamine, myristylamine, and the like.

(f) oxyalkylene amines, including the "Jeffamine" ® series of mono, di, and triamines which are available from Texaco Chemical Company. These amines are ethoxylated and/or propoxylated polyamines.

(g) hydroxylated polyamines, such as N,N,N',N'-tetrakis(2-hydroxypropyl)ethylenediamine; N,N',N'-tris(2-hydroxyethyl)-N-tallow-1,3-diaminopropane; and the like.

The multifunctional process antifoulant further comprises at least one additional compound, selected from components (2), (3), (4), and mixtures thereof as described below.

Component (2) is an antioxidant compound adapted to inhibit oxygen based polymerization in petrochemical or hydrocarbon process streams.

Exemplary antioxidant compounds, component (2), include:

(a) phenylenediamine compounds such as N-phenyl-N'(1,3-dimethylbutyl)-p-phenylenediamine, N-phenyl-N'(1,4-dimethylpentyl)p-phenylenediamine, or N-phenyl-N'(1,4-dimethylpropyl)-p-phenylenediamine;

(b) phenolics such as ortho-tert-butyl-para-methoxyphenol, cresylic acid, aminophenol, 2,6-ditertiarybutylphenol, or 4,4' methylenebis-(2,6-ditertiarybutylphenol);

(c) quinones such as tertiary-butylcatechol, benzoquinone, tertiary-butylhydroquinone and the like;

(d) alkaline earth salts of alkylphenol sulfides, such as calcium or magnesium sulfurized phenates;

(e) sulfur/amine containing materials such as diakyl dithiocarbamates or phenothiazine and alkylated derivatives or sulfur/phosphorus containing materials such as metal or amine salts of dialkyl dithiophosphoric acids.

Component (3) comprises a corrosion inhibiting compound. The following corrosion inhibiting compounds (3) are exemplary:

(a) substituted amines such as tetrahydropyrimidine, imidazolines, alkylene polyamines and the like;

(b) corrosion inhibiting reaction products obtained by: (1) reacting at least one alkylene polyamine with a sufficient quantity of at least one aliphatic carboxylic acid to produce a salt of said amine and acid, said salt being of such nature that the amine reactant is decharacterized to the extent that the likelihood of an amine-aldehyde condensation polymerization is substantially eliminated, and (2) reacting the salt with a lower aldehyde. This process is described in U.S. Pat. No. 3,567,623 (Hagney) incorporated herein by reference. The reaction product of $CH_3(CH_2)_{17}$—NH—$(CH_2)_3$—$NH_2$, a tall oil head, and paraformaldehyde, see Example 1 of U.S. Pat. No. 3,567,623 (Hagney), is especially preferred;

(c) the reaction product obtained by reacting at least one alkylene polyamine with a sufficient quantity of at least one aliphatic carboxylic acid to produce a salt of said amine and acid, said salt being of such nature that the amine reactant is decharacterized to the extent that the likelihood of an amine-aldehyde condensation polymerization is substantially eliminated;

(d) alkaline earth (group 2) metal salts of oil-soluble alkyl benzene sulfonic acids, such as magnesium or calcium sulfonates;

(e) amine salts of oil-soluble alkyl naphthalene sulfonic acids, such as the ammonium or ethylenediamine sulfonates;

(f) 2,5-dimercapto-1,3,4-thiadiazole and derivatives;

(g) ethoxylated or propoxylated derivatives of alkyl phenols;

(h) the reaction product of tallowamines and methyl acrylate or acrylic acid;

(i) the reaction product of tall oil fatty acids and a polyamine such as diethylenetriamine. Tall oil fatty acids are a mixture of fatty acids derived from tall oils.

Component (4) comprises compounds adapted to deactivate metals such as copper and iron which would otherwise catalyze polymerization of impurities in the petrochemical or hydrocarbon, leading to gums and deposit formation. Exemplary metal deactivators, component (4), include:

(a) N,N'-disalicylidene-1,2-cyclohexanediamine;
(b) sodium N,N'-ethylenebis(2,5-sodium sulfocarbolate) glycinate;
(c) 2,5-dimercapto-1,3,4-thiadiazole derivatives;
(d) reaction products of an alkylphenol, an aldehyde, and a polyamine such as nonylphenol, formaldehyde and ethylenediamine; optionally, dialkyl or alkoxyphenols may be used in place of alkylphenol.

Accordingly, the multifunctional antifoulant compositions and methods comprise compound (1) and an additional antifouling component(s) selected from the group consisting of compounds defined by the numbers (2), (3), and (4), supra. The ratio of weight ranges of component (1): additional antifouling components may be on the order of from about 20 to about 99.7 wt % component (1): from about 0.3 to about 80 wt % additional antifouling components (i.e., components (2), (3), (4)) with the weight percentage equalling 100 wt %. A preferred range of component (1): additional antifouling components is from about 50 to about 99.7 wt %: from about 0.3 to about 50 wt %. When all four components are present, the ratio of weight ranges of components (1):(2):(3):(4) in the solvent may be from about 20 to about 99.7: from about 0.1 to about 25: from about 0.1 to about 45: from about 0.1 to about 10. The compositions may be dissolved in a nonpolar solvent such as aromatic naphtha or any suitable refined hydrocarbon for the purpose of providing an injectable antifoulant formulation.

The compositions may be used in any of the environments described hereinabove in the "Background" to aid in solving or preventing the particular fouling problems therein described. Generally, they are fed to the process fluid in an amount of from about 0.5 to about 10,000 ppm total actives, components (1), (2), (3), and (4), based upon one million parts petroleum hydrocarbon or petrochemical. Preferably, the multifunctional antifoulant compositions are added in an amount of from about 1 to about 1000 ppm total actives, components (1), (2), (3), and (4). It is noted that at least one of the components (2), (3), or (4) must be conjointly used with component (1).

The invention will be further illustrated by the following examples which are included as being illustrative of the invention and which should not be construed as limiting the scope thereof.

EXAMPLES

In order to ascertain the antifoulant efficacy of the compounds of the present invention, an apparatus that pumps process fluid (crude oil) from a pressure vessel through a heat exchanger containing an electrically heated rod was used. Then the process fluid was chilled back to room temperature in a water-cooled condenser before being remixed with the fluid in the pressure vessel. The system was pressurized by nitrogen to minimize vaporization of the process fluid.

The Dual Fouling Apparatus (DFA) used to generate the data shown in Table 1 contains two heated rod exchangers that are independent except for a common pump drive transmission. In the DFA tests the rod temperature was controlled at 800° F. or 900° F. while testing mid-continent or Gulf Coast crude oils. As fouling on the rod occurs, less heat is transferred to the fluid so that the process fluid outlet temperature decreases. Antifoulant protection was determined by comparing the summed areas under the fouling curves of the oil outlet temperatures for control, treated and ideal (non-fouling) runs. In this method, the temperatures of the oil inlet and outlet and rod temperatures at the oil inlet (cold end) and outlet (hot end) are used to calculate U-rig coefficients of heat transfer every 30 minutes during the tests. From these U-rig coefficients, areas under the fouling curves are calculated and summed over the tests for the control and treatments. The ideal case is represented as the summed area using the highest U-rig coefficient. Comparing the areas of control runs (averaged) and treated runs vs the ideal area in the following equation results in a percent protection value for antifoulants.

$$1 - \frac{\text{Area (ideal)} - \text{Area (treatment)}}{\text{Area (ideal)} - \text{Area (control)}} * 100 = \%\ \text{protection}$$

Table 1 shows the percent protections obtained on control runs and treated runs containing varying combinations of a slightly overbased calcium alkyl phosphonate phenate sulfide (CPPS) used as the basic antifoulant, component (1), a phenylenediamine (PDA), specifically N'-phenyl-N'(1,3-dimethylbutyl)-p-phenylenediamine, used as the antioxidant compound, component (2), the reaction product of tallowtetramine and methylacrylate (TTMA) as a corrosion inhibitor, component (3), and the reaction product of nonylphenol, formaldehyde, and ethylenediamine (NFE) as the metal deactivator, component (4).

In all of the examples below, CPPS is a commercially available product that is sold in a solution with process oil, with the concentration of CPPS in process oil being about 51.5% (wt). Chemical properties of the CPPS used are:

| | Typical |
|---|---|
| Calcium % wt. | 1.65 |
| Phosphorus % wt. | 1.1 |
| Sulfur % wt. | 3.6 |
| Specific Gravity | 0.95 |
| Total Base Number | 46 |
| Viscosity at 100° C., cSt | 451 |

TABLE 1

DUAL FOULING APPARATUS RESULTS

| Example | Additive | ppm, Active | Δ Area[1] | % Protection |
|---|---|---|---|---|
| Colorado Refinery Crude Oil - 800° F. Rod Temperature | | | | |
| 1 | Control | 0 | 21.1 (Avg 3 runs) | 0 (Avg) |
| 2 | Calcium phosphonate Phenate Sulfide (CPPS) | 125 | 9.6 (Avg 2 runs) | 55 (Avg) |
| 3 | | 250 | 4.7 | 78 |
| 4 | CPPS/PDA/TTMA/NFE | 32/26/55/14 | 4.7 | 78 |
| 5 | | 63/52/110/28 | 1.1 | 95 |
| 6 | CPPS/PDA/TTMA | 82/35/13 | 2.3 | 89 |
| 7 | | 163/71/26 | 3.8 | 82 |
| Texas Refinery Crude Oil - 900° F. Rod Temperature | | | | |
| 8 | Control | 0 | 31.4 (Avg 9 runs) | 0 (Avg) |
| 9 | CPPS | 125 | 20.5 | 35 |
| 10 | CPPS/TTMA/PAS | 49/25/26 | 15.6 | 50 |
| 11 | | 98/50/52 | 10.3 | 67 |
| Alternate Texas Refinery Crude Oil - 900° F. Rod Temperature | | | | |
| 12 | Control | 0 | 20.8 (Avg 9 runs) | 0 (Avg) |
| 13 | CPPS | 50 | 12.7 | 39 |

TABLE 1-continued

| DUAL FOULING APPARATUS RESULTS | | | | |
|---|---|---|---|---|
| Example | Additive | ppm, Active | Δ Area[1] | % Protection |
| 14 | CPPS/PDA/TTMA | 20/20/31 | 11.1 | 47 |

[1]ΔArea = Area (ideal) − Area (treatment or control)

Examples 4 and 5 contain four components, one each from all four groups of antifouling components, and exhibited similar to higher antifoulant protections at lower active dosages of CPPS than when CPPS was used alone (examples 2 and 3). Examples 6 and 7 contain three components, one each from components (1), (2), and (3) and exhibited higher antifoulant protections at similar to lower active dosages of CPPS than when CPPS was used alone (example 2 and 3). Examples 10 and 11, containing CPPS, TTMA and a small amount of a well-known antifoulant dispersant polyalkenylsuccinimide (PAS), exhibited higher antifoulant protection at similar to lower active dosage compared to use of CPPS alone (example 9). Example 14, containing three components, exhibited slightly higher efficacy at a lower active CPPS dosage than when CPPS was used alone (example 13). As these examples clearly demonstrate, use of multifunctional antifoulant compositions of the present invention provide significant antifoulant efficacy and an improvement compared to use of CPPS alone.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What I claim is:

1. A method of inhibiting fouling deposit formation in a liquid hydrocarbonaceous medium, undergoing processing wherein in the absence of such fouling inhibition, fouling deposits would normally be formed within said medium, said method comprising adding to said medium an effective amount of an antifoulant composition comprising:

Component (1) an alkyl phosphonate phenate sulfide antifoulant compound formed from the reaction of an alkyl ($C_1$–$C_{24}$) phenol sulfide and phosphoric acid; and at least one additional compound selected from the group consisting of:

Component (2) an effective antioxidant compound or compounds to inhibit oxygen based polymerization of said hydrocarbon medium selected from the group consisting of: phenylenediamine compounds, substituted phenolic compounds, quinone and its derivatives; or phenothiazine and its derivatives;

Component (3) a corrosion inhibiting compound or compounds to reduce corrosion of metal surfaces in contact with said hydrocarbon medium during processing thereof, selected from the group consisting of: tetrahydropyrimidines; imidazolines; reaction products of alkylene polyamines and aliphatic carboxylic acids and optionally further reacted with paraformaldehyde to give heterocyclic compounds; magnesium, calcium or amine sulfonates; reaction products of ethylene or propylene oxide with alkyl phenol to yield aromatic ethers or reaction products of a tallowpolyamine and an alkylacrylate; and Component (4) a metal deactivator compound or compounds adapted to complex with metallic impurities in said hydrocarbon medium selected from the group consisting of: N,N'-disalicylidene-1,2-cyclohexanediamine; 2,5-dimercapto-1,3,4-thiadiazole and its derivatives; or reaction products of alkyl phenol, aldehyde and polyamines to yield Mannich products; and mixtures thereof.

2. A method as recited in claim 1 comprising feeding from about 0.5 to about 10,000 parts of said antifoulant composition to said medium per one million parts of said medium.

3. A method as recited in claim 1 comprising feeding from about 1 to about 500 parts of said antifouling composition to said medium per one million parts of said medium.

4. A method as recited in claim 2 wherein said alkyl phosphonate phenate sulfide, component (1), is an overbased alkaline earth metal alkyl phosphonate phenate sulfide.

5. A method as recited in claim 2 wherein said medium is heated to a temperature of about 100° to about 1000° F.

6. A method as recited in claim 5 wherein said medium is heated to a temperature of about 600° F. to about 1000° F.

7. A method as recited in claim 4 wherein said alkaline earth metal alkyl phosphonate phenate sulfide is calcium alkyl phosphonate phenate sulfide.

8. A method as recited in claim 4 wherein said alkaline earth metal alkyl phosphonate phenate sulfide is magnesium alkyl phosphonate phenate sulfide.

9. A method as recited in claim 2 wherein said alkyl phosphonate phenate sulfide is an amine neutralized alkyl phosphonate phenate sulfide, wherein the neutralizing amine or amines is/are selected from the group consisting of ammonia, alkylamines, arylamines, cycloalkylamines, alkanolamines, fatty amines, oxyalkylene amines, hydroxylated polyamines, and mixtures thereof.

10. A method as recited in claim 9 wherein said amine neutralized alkyl phosphonate phenate sulfide comprises an alkanolamine neutralized alkyl phosphonate phenate sulfide.

11. A method as recited in claim 2 wherein said antioxidant, component (2), is present and comprises a phenylenediamine compound.

12. A method as recited in claim 11 wherein said phenylenediamine compound is selected from the group consisting of N-phenyl-N'(1,3-dimethylbutyl)-p-phenylenediamine, N-phenyl-N'(1,4-dimethylpentyl)-p-phenylenediamine, and N-phenyl-N'(1,3-dimethylpropyl)-p-phenylenediamine, and mixtures thereof.

13. A method as recited in claim 2 wherein said corrosion inhibitor, component (3), is present and comprises tetrahydropyrimidene.

14. A method as recited in claim 2 wherein said corrosion inhibitor, component (3), is present and comprises a corrosion inhibiting reaction product obtained by: (a) reacting at least one alkylene polyamine with a sufficient quantity of at least one aliphatic carboxylic acid to produce a salt of said amine and said acid, said salt being of such nature that the amine reactant is decharacterized to the extent that the likelihood of an amine-aldehyde condensation polymerization is substantially eliminated.

15. A method as recited in claim 14 further comprising reacting said salt with a lower aldehyde.

16. A method as recited in claim 14 wherein said corrosion inhibitor is a reaction product of $CH_3(CH_2)_{17}$—NH—$(CH_2)_3$—$NH_2$ and a tall oil head.

17. A method as recited in claim 15 wherein said corrosion inhibitor is a reaction product of $CH_3(CH_2)_{17}$—NH—$(CH_2)_3$—$NH_2$, a tall oil head and paraformaldehyde.

18. A method as recited in claim 2 wherein said corrosion inhibitor, component (3), is present and comprises a reaction product of a tallowpolyamine and an alkylacrylate.

19. A method as recited in claim 2 wherein said corrosion inhibitor, component (3), is present and comprises a reaction product of tall oil fatty acids and a polyamine.

20. A method as recited in claim 2 wherein said metal deactivator, component (4), is present and comprises a reaction product of a substituted phenol selected from the group consisting of alkylphenol, dialkylphenol, alkoxyphenol, and mixtures thereof; an aldehyde, and a polyamine.

21. A method as recited in claim 20 wherein said metal deactivator, component (4) comprises the reaction product of nonylphenol, formaldehyde and ethylenediamine.

22. A method as recited in claim 2 wherein said metal deactivator, component (4), is present and comprises N,N'-disalicylidene-1,2-cyclohexanediamine.

23. A method of inhibiting fouling in a liquid hydrocarbon medium undergoing processing at a temperature of from about 100° to about 1000° F. wherein in the absence of such fouling inhibition, fouling deposits would normally be formed within said medium, said method comprising adding from about 0.5 to about 10,000 parts of an antifoulant composition to said hydrocarbon medium per one million parts of said medium, said antifoulant composition comprising an effective amount of:

Component (1) a compound selected from the group consisting of slightly overbased alkaline earth alkyl phosphonate phenate sulfides, alkyl phosphonate phenate sulfides, amine neutralized alkyl phosphonate phenate sulfides and mixtures thereof; and at least one additional compound selected from the group consisting of:

Component (2) an effective antioxidant compound or compounds to inhibit oxygen based polymerization of said hydrocarbon medium selected from the group consisting of: phenylenediamine compounds, substituted phenolic compounds, quinone and its derivatives; or phenothiazine and its derivatives;

Component (3) a corrosion inhibiting compound or compounds to reduce corrosion of metal surfaces in contact with said hydrocarbon medium during processing thereof, selected from the group consisting of: tetrahydropyrimidines; imidazolines; reaction products of alkylene polyamines and aliphatic carboxylic acids and optionally further reacted with paraformaldehyde to give heterocyclic compounds; magensium, calcium or amine sulfonates; reaction products of ethylene or propylene oxide with alkyl phenol to yield aromatic ethers; or reaction products of a tallowpolyamine and an alkylacrylate; and Component (4) a metal deactivator compound or compounds adapted to complex with metallic impurities in said hydrocarbon medium selected from the group consisting of: N,N'-disalicylidene-1,2-cyclohexanediamine; 2,5-dimercapto-1,3,4-thiadizole and its derivatives; or reaction products of alkyl phenol, aldehyde and polyamines to yield Mannich products; and mixtures thereof.

24. A method as recited in claim 23 wherein said hydrocarbon medium is heated to a temperature of about 600° to about 1000° F.

25. A method as recited in claim 23 comprising adding from about 1 to about 500 parts of the combination of component (1) and additional antifouling components, to said medium, based upon one million parts of said hydrocarbonaceous medium.

26. A method as recited in claim 23 wherein said antifouling compound, component (1), is a calcium alkyl phosphonate phenate sulfide.

27. A method as recited in claim 23 wherein said antifouling compound, component (1), is an alkanolamine neutralized alkyl phosphonate phenate sulfide.

28. A method as recited in claim 27 wherein said antifouling compound, component (1), is triethanolamine neutralized alkyl phosphonate phenate sulfide.

29. A method as recited in claim 23 wherein said antioxidant, component (2), is present and comprises a phenylenediamine compound.

30. A method as recited in claim 29 wherein said phenylenediamine compound is selected from the group consisting of N-phenyl-N'(1,3-dimethylbutyl)-p-phenylenediamine, N-phenyl-N'(1,4-dimethylpentyl)-p-phenylenediamine, N-phenyl-N'(1,3-dimethylpropyl)-p-phenylenediamine, and mixtures thereof.

31. A method as recited in claim 23 wherein said corrosion inhibitor, component (3), is present and comprises tetrahydropyrimidene.

32. A method as recited in claim 23 wherein said corrosion inhibitor, component (3), is present and comprises a corrosion inhibiting reaction product obtained by: reacting at least one alkylene polyamine with a sufficient quantity of at least one aliphatic carboxylic acid to produce a salt of said amine and said acid, said salt being of such nature that the amine reactant is decharacterized to the extent that the likelihood of an aminealdehyde condensation polymerization is substantially eliminated.

33. A method as recited in claim 32 wherein said corrosion inhibitor, component (3), is a reaction product of $CH_3(CH_2)_{17}$—NH—$(CH_2)_3$—$NH_2$ and a tall oil head.

34. A method as recited in claim 32 further comprising reacting said salt with a lower aldehyde.

35. A method as recited in claim 34 wherein said corrosion inhibitor is a reaction product of $CH_3(CH_2)_{17}$—NH—$(CH_2)_3$—$NH_2$, a tall oil head and paraformaldehyde.

36. A method recited in claim 23 wherein said corrosion inhibitor, component (3) is present and comprises a reaction product of a tallowpolyamine and an alkylacrylate.

37. A method as recited in claim 23 wherein said corrosion inhibitor, component (3), is present and comprises a reaction product of tall oil fatty acids and a polyamine.

38. A method as recited in claim 23 wherein said metal deactivator, component (4), is present and comprises a reaction product of a substituted phenol selected from the group consisting of alkylphenol, dialkylphenol, and alkoxyphenol; an aldehyde, and a polyamine.

39. A method as recited in claim 38 wherein said metal deactivator, component (4), comprises the reaction product of nonylphenol, formaldehyde, and ethylenediamine.

40. A method as recited in claim 23 wherein said metal deactivator, component (4), is present and comprises N,N'-disalicylidene-1,2-cyclohexanediamine.

41. A method as recited in claim 23 wherein said antifoulant composition comprises an effective amount of: component (1), a calcium alkyl phosphonate phenate sulfide; component (2), an effective antioxidant compound adapted to inhibit oxygen based polymerization of said medium; and component (3), a corrosion inhibiting compound or compounds.

42. A method as recited in claim 41 wherein said antifoulant composition further comprises component (4), a metal deactivator compound or compounds adapted to complex with metallic impurities in said medium.

43. A method as recited in claim 23 wherein said antifoulant composition comprises: component (1) and at least two additional compounds selected from the group consisting of component (2), component (3), component (4), and mixtures thereof.

44. A method of inhibiting fouling deposit formation in a liquid hydrocarbonaceous medium undergoing processing at about 100° to about 1000° F., wherein in the absence of such fouling inhibition, fouling deposits would normally be formed within said medium, said method comprising adding to said medium from about 0.5 to about 10,000 ppm of an antifoulant comprising said antifoulant composition comprising:

Component (1) an alkyl phosphonate phenate sulfide antifoulant compound formed from reaction of an alkyl ($C_1$–$C_{24}$) phenol sulfide and phosphoric acid; and at least one additional compound selected from the group consisting of:

Component (2) an effective antioxidant compound or compounds adapted to inhibit oxygen based polymerization of said hydrocarbon medium selected from the group consisting of: phenylenediamine compounds, substituted phenolic compounds, quinone and its derivatives; or phenothiazine and its derivatives;

Component (3) a corrosion inhibiting compound or compounds to reduce the corrosion of metal surfaces in contact with said hydrocarbon medium during processing thereof, selected from the group consisting of: tetrahydropyrimidines; imidazolines; reaction products of alkylene polyamines and aliphatic carboxylic acids and optionally further reacted with paraformaldehyde to give heterocyclic compounds; magnesium, calcium or amine sulfonates; reaction products of ethylene or propylene oxide with alkyl phenol to yield aromatic ethers; or reaction products of a tallowpolyamine and an alkylacrylate; and Component (4) a metal deactivator compound or compounds adapted to complex with metallic impurities in said hydrocarbon medium selected from the group consisting of: N,N'-disalicylidene-1,2-cyclohexanediamine; 2,5-dimercapto-1,3,4-thiadiazole and its derivatives; or reaction products of alkyl phenol, aldehyde and polyamines to yield Mannich products; and mixtures thereof.

45. A method as recited in claim 44 wherein said hydrocarbon medium is undergoing processing at about 600° to about 1000° F.

46. A method as recited in claim 44 comprising feeding from about 1 to about 500 parts of said antifouling composition to said medium per one million parts of said medium.

47. A method as recited in claim 44 wherein said alkyl phosphonate phenate sulfide, component (1), is an overbased alkaline earth metal alkyl phosphonate phenate sulfide.

48. A method as recited in claim 47 wherein said alkaline earth metal alkyl phosphonate phenate sulfide is calcium alkyl phosphonate phenate sulfide.

49. A method as recited in claim 47 wherein said alkaline earth metal alkyl phosphonate phenate sulfide is magnesium alkyl phosphonate phenate sulfide.

50. A method as recited in claim 44 wherein said alkyl phosphonate phenate sulfide is an amine neutralized alkyl phosphonate phenate sulfide, wherein the neutralizing amine or amines is/are selected from the group consisting of ammonia, alkylamines, arylamines, cycloalkylamines, alkanolamines, fatty amines, oxyalkylene amines, hydroxylated polyamines, and mixtures thereof.

51. A method as recited in claim 50 wherein said amine neutralized alkyl phosphonate phenate sulfide comprises an alkanolamine neutralized alkyl phosphonate phenate sulfide.

52. A method as recited in claim 44 wherein said antioxidant, component (2), is present and comprises a phenylenediamine compound.

53. A method as recited in claim 52 wherein said phenylenediamine compound is selected from the group consisting of N-phenyl-N'(1,3-dimethylbutyl)-p-phenylenediamine, N-phenyl-N'(1,4-dimethylpentyl)-phenylenediamine, and N-phenyl-N'(1,3-dimethylpropyl)-p-phenylenediamine, and mixtures thereof.

54. A method as recited in claim 44 wherein said corrosion inhibitor, component (3), is present and comprises tetrahydropyrimidene.

55. A method as recited in claim 44 wherein said corrosion inhibitor, component (3), is present and comprises a corrison inhibiting reaction product obtained by: (a) reacting at least one alkylene polyamine with a sufficient quantity of at least one aliphatic carboxylic acid to produce a salt of said amine and said acid, said salt being of such nature that the amine reactant is decharacterized to the extent that the likelihood of an amine-aldehyde condensation polymerization is substantially eliminated.

56. A method as recited in claim 55 wherein said corrosion inhibitor is a reaction product of $CH_3(CH_2)_{17}$—NH—$(CH_2)_3$—$NH_2$ and a tall oil head.

57. A method as recited in claim 55 further comprising reacting said salt with a lower aldehyde.

58. A method as recited in claim 57 wherein said corrosion inhibitor is a reaction product of $CH_3(CH_2)_{17}$—NH—$(CH_2)_3$—$NH_2$, a tall oil head and paraformaldehyde.

59. A method as recited in claim 44 wherein said corrosion inhibitor, component (3), is present and comprises a reaction product of a tallowpolyamine and alkylacrylate.

60. A method as recited in claim 44 wherein said corrosion inhibitor, component (3), is present and comprises a reaction product of tall oil fatty acids and a polyamine.

61. A method as recited in claim 44 wherein said metal deactivator, component (4), is present and comprises a reaction product of a substituted phenol selected from the group consisting of alkyl phenol, dialkylphenol, alkoxyphenol, and mixtures thereof; an aldehyde, and a polyamine.

62. A method as recited in claim 61 wherein said metal deactivator, component (4) comprises the reaction product of nonyl phenyl, formaldehyde and ethylenediamine.

63. A method as recited in claim 44 wherein said metal deactivator, component (4), is present and comprises N,N'-disalicylidene-1,2-cyclohexanediamine.

64. A method of inhibiting fouling in a liquid hydrocarbon medium undergoing processing at a temperature of from about 600° to 1000° F. wherein in the absence of such fouling inhibition, fouling deposits would normally be formed within said medium, said method comprising adding from about 0.5 to about 10,000 parts of an antifoulant composition to said hydrocarbon medium per one million parts of said medium, said antifoulant composition comprising an effective amount of:

Component (1) a compound selected from the group consisting of slightly overbased alkaline earth alkyl phosphonate phenate sulfides, alkyl phosphonate phenate sulfides, amine neutralized alkyl phosphonate phenate sulfides and mixtures thereof; and at least one additional compound selected from the group consisting of:

Component (2) an effective antioxidant compound or compounds adapted to inhibit oxygen based polymerization of said hydrocarbon medium selected from the group consisting of: phenylenediamine compounds, substituted phenolic compounds, quinone and its derivatives; or phenothiazine and its derivatives;

Component (3) a corrosion inhibiting compound or compounds to reduce corrosion of metal surfaces in contact with said hydrocarbon medium during processing thereof, selected from the group consisting of: tetrahydropyrimidines; imidazolines; reaction products of alkylene polyamines and aliphatic carboxylic acids and optionally further reacted with paraformaldehyde to give heterocyclic compounds; magnesium, calcium or amine sulfonates; reaction products of ethylene or propylene oxide with alkyl phenol to yield aromatic ethers; or reaction products of a tallowpolyamine and an alkylacrylate; and Component (4) a metal deactivator compound or compounds adapted to complex with metallic impurities in said hydrocarbon medium selected from the group consisting of N,N'-disalicylidene-1,2-cyclohexanediamine; 2,5-dimercapto-1,3,4-thiadiazole and its derivatives; or reaction products of alkyl phenol, aldehyde and polyamines to yield Mannich products; and mixtures thereof.

65. A method as recited in claim 64 comprising adding from about 1 to 500 parts of the combination of components (1) and additional antifouling components, to said medium, based upon one million parts of said hydrocarbonaceous medium.

66. A method as recited in claim 64 wherein said antifouling compound, component (1), is a calcium alkyl phosphonate phenate sulfide.

67. A method as recited in claim 64 wherein said antifouling compound, component (1), is an alkanolamine neutralized alkyl phosphonate phenate sulfide.

68. A method as recited in claim 67 wherein said antifouling compound, component (1), is triethanolamine neutralized alkyl phosphonate phenate sulfide.

69. A method as recited in claim 64 wherein said antioxidant, component (2), is present and comprises a phenylenediamine compound.

70. A method as recited in claim 69 wherein said phenylenediamine compound is selected from the group consisting of N-phenyl-N'(1,3-dimethylbutyl)-p-phenylenediamine, N-phenyl-N'(1,4-dimethylpentyl)-p-phenylenediamine, N-phenyl-N'(1,3-dimethylpropyl)-p-phenylenediamine, and mixtures thereof.

71. A method as recited in claim 64 wherein said corrosion inhibitor, component (3), is present and comprises tetrahydropyrimidene.

72. A method as recited in claim 64 wherein said corrosion inhibitor, component (3), is present and comprises a corrosion inhibiting reaction product obtained by: reacting at least one alkylene polyamine with a sufficient quantity of at least one aliphatic carboxylic acid to produce a salt of said amine and said acid, said salt being of such nature that the amine reactant is decharacterized to the extent that the likelihood of an amine aldehyde condensation polymerization is substantially eliminated.

73. A method as recited in claim 72 wherein said corrosion inhibitor, component (3), is a reaction product of $CH_3(CH_{12})_{17}$—NH—$(CH_2)_3$—$NH_2$ and a tall oil head.

74. A method as recited in claim 72 further comprising reacting said salt with a lower aldehyde.

75. A method as recited in claim 74 wherein said corrosion inhibitor is a reaction product of $CH_3(CH_2)_{17}$—NH—$(CH_2)_3$—$NH_2$, a tall oil head and paraformaldehyde.

76. A method as recited in claim 64 wherein said corrosion inhibitor, component (3), is present and comprises a reaction product of tallowpolyamine and an alkylacrylate.

77. A method as recited in claim 64 wherein said corrosion inhibitor, component (3), is present and comprises a reaction product of tall oil fatty acids and a polyamine.

78. A method as recited in claim 64 wherein said metal deactivator, component (4), is present and comprises a reaction product of a substituted phenol selected from the group consisting of alkyl phenol, dialkylphenol, and alkoxyphenol; and aldehyde, and a polyamine.

79. A method as recited in claim 78 wherein said metal deactivator, component (4), comprises the reaction product of nonyl phenyl, formaldehyde, and ethylenediamine.

80. A method as recited in claim 64 wherein said metal deactivator, component (4), is present and comprises N,N'-disalicylidene-1,2-cyclohexanediamine.

81. A method as recited in claim 64 wherein said antifoulant composition comprises an effective amount of: component (1), a calcium alkyl phosphonate phenate sulfide; component (2), an effective antioxidant compound adapted to inhibit oxygen based polymerization of said medium; and component (3), a corrosion inhibiting compound or compounds.

82. A method as recited in claim 81 wherein said antifoulant composition further comprises component (4), a metal deactivator compound or compounds adapted to complex with metallic impurities in said medium.

83. A method as recited in claim 64 wherein said antifoulant composition comprises: component (1) and at least two additional compounds selected from the group consisting of component (2), component (3), component (4), and mixtures thereof.

* * * * *